US012510314B2

(12) United States Patent
Seidl

(10) Patent No.: US 12,510,314 B2
(45) Date of Patent: Dec. 30, 2025

(54) BREECH BLOCK AND RIFLE WITH SUCH A BREECH BLOCK

(71) Applicant: Blaser Group GmbH, Isny (DE)

(72) Inventor: Paul Seidl, Argenbühl (DE)

(73) Assignee: Blaser Group GmbH, Isny (DE)

( * ) Notice: Subject to any disclaimer, the term of this patent is extended or adjusted under 35 U.S.C. 154(b) by 0 days.

(21) Appl. No.: 18/621,177

(22) Filed: Mar. 29, 2024

(65) Prior Publication Data

US 2024/0328733 A1 Oct. 3, 2024

(30) Foreign Application Priority Data

Mar. 30, 2023 (DE) ..... 10 2023 108 217.5

(51) Int. Cl.
*F41A 3/40* (2006.01)
*F41A 3/48* (2006.01)

(52) U.S. Cl.
CPC . *F41A 3/40* (2013.01); *F41A 3/48* (2013.01)

(58) Field of Classification Search
CPC ..... F41A 3/40; F41A 3/46
USPC ..... 89/187.01, 189, 190
See application file for complete search history.

(56) References Cited

U.S. PATENT DOCUMENTS 3,370,372 A * 2/1968 Thompson ..... F41A 3/40 42/16
3,566,745 A 3/1971 Jauch
3,835,566 A 9/1974 Bielfeldt
4,194,433 A * 3/1980 Zellweger ..... F41A 3/40 89/190
4,240,325 A 12/1980 Hurlemann
4,815,356 A 3/1989 Hupp
5,726,376 A * 3/1998 Menges ..... F41A 3/44 89/190
2005/0235817 A1* 10/2005 Murello ..... F41A 3/46 89/33.01

FOREIGN PATENT DOCUMENTS

DE 641356 C 1/1937
DE 1242478 B 6/1967
DE 1578392 A1 5/1971
DE 2227780 A1 12/1973
DE 3045831 A1 6/1982

OTHER PUBLICATIONS

Result of examination report for German Patent Application No. 10 2023 108 217.5, filed Mar. 30, 2023.

* cited by examiner

*Primary Examiner* — Bret Hayes
(74) *Attorney, Agent, or Firm* — Fleit Intellectual Property Law; Paul D. Bianco

(57) ABSTRACT

A breech block with a bolt carrier, on which a bolt head and a locking device are arranged with two diametrically opposed locking elements pivotable from a release position to a locking position via a control element, for holding the bolt head in a locking position. The locking elements are mounted pivotably around a common transverse axis via journals and the control element contains front and rear support areas that abut against the locking elements for controlled forced movement of the locking elements into both the locking position and the release position.

12 Claims, 6 Drawing Sheets

BREECH BLOCK AND RIFLE WITH SUCH A BREECH BLOCK

FIELD OF THE INVENTION

The invention relates to a breech block. The invention also relates to a rifle with such a breech block.

BACKGROUND

Breech blocks generally contain a breech element movable relative to a chamber and lockable in the closed position by means of a locking device, which contains a bolt head at its front to seal off the chamber to the rear.

A breech for an automatic firearm is known from DE 30 45 831 A1 with a bolt head and a locking device to secure the bolt head in a locking position. The locking device consists of two support flaps mounted loosely in the bolt head, which are pivotably mounted in the bolt head around two spaced-apart transverse axes and can be moved by a support sleeve from an inwardly tilted release position into an outwardly pivoted locking position.

SUMMARY

One aspect of the invention relates to a breech block and rifle with such a breech block which enable functionally reliable movement of the locking element between the locking position and the release position.

Accordingly a breech block and a rifle are disclosed herein. Further developments and advantageous embodiments of the invention are also disclosed herein.

The breech block according to the invention contains a bolt carrier on which a bolt head and a locking device are arranged with two diametrically opposed locking elements pivotable via a control element from a release position into a locking position to secure the bolt head in a locking position. The locking elements are mounted to pivot via journals around a common transverse axis and the control element has front and rear support areas which abut against the locking elements for controlled forced movement of the locking elements into both the locking position and the release position. This can ensure that the locking elements reliably reach not only their locking position, but also their release position even without springs or other costly restoring elements. In this way functional safety and reliability can be improved.

In a particularly advantageous embodiment, the locking elements are designed half-shell shaped and are pivotably mounted via two opposing journals in aligned transverse holes of two parallel holding elements. The bolt head can be held against the front ends of the plate-like holding elements, which are preferably designed as sheet metal parts.

The opposed journals of the locking elements can be advantageously designed as half-rings and the two locking elements rest with their opposing journals against an upper or lower inside wall of the aligned transverse holes. The two locking elements can be secured to pivot against the holding elements via pins inserted between the half-ring-shaped journals.

Secure guidance of the locking elements can be achieved by providing the two locking elements with an outwardly curved support surface on the front side thereof for contact with an inwardly curved guide surface on the back of the bolt head.

In a preferred embodiment, the two locking elements have a front part which protrudes forward relative to the journal and a rear part which protrudes rearward relative to the journals. On the outside of the front part of the locking elements, outwardly protruding locking shoulders are preferably arranged for engagement in an annular groove on the rear end of a locking sleeve or a barrel. An oblique front control surface can be provided on the inside of the front part of the locking elements for moving the locking elements into the locking position and an oblique rear control surface can be arranged on the inside of the rear part of the locking elements for moving the locking elements into the release position.

The preferably sleeve-like control element has a front support area on its front end cooperating with the front support surfaces of the locking elements for moving the locking elements into the locking position and a rear support area cooperating with the rear support surface of the locking elements for moving the locking elements into the release position.

The invention also relates to a rifle having the breech block described above.

BRIEF DESCRIPTION OF THE DRAWINGS

Additional details and advantages of the invention will become apparent from the following description of a preferred illustrative embodiment with reference to the drawing. In the drawing.

DETAILED DESCRIPTION

Figure 1:
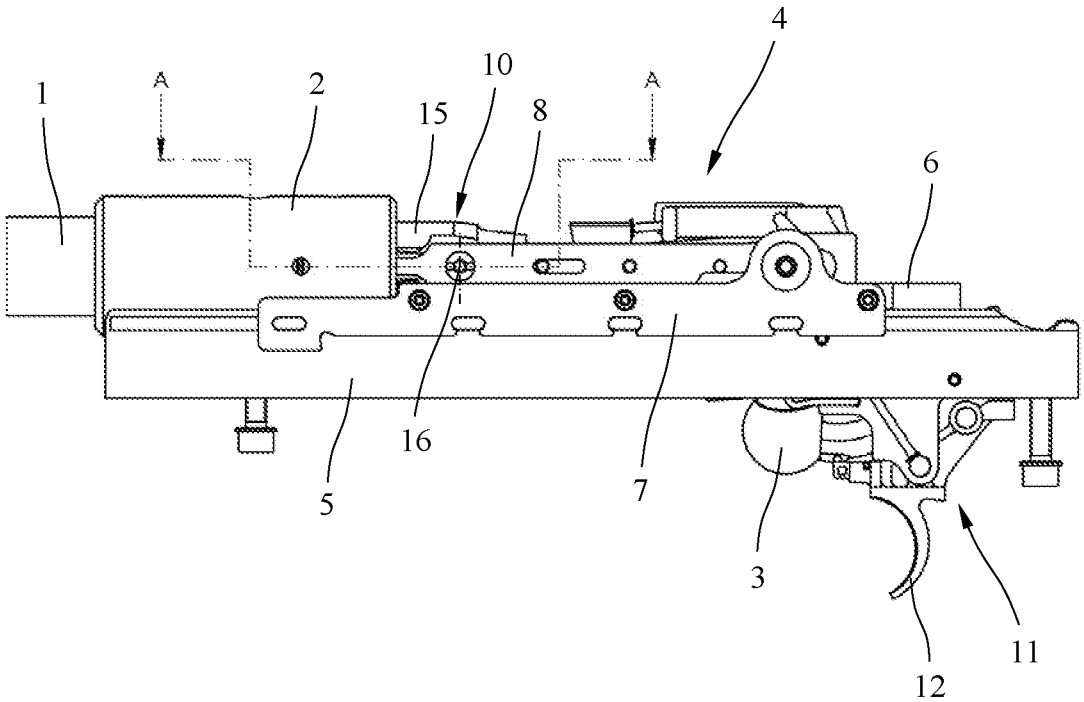
FIG. 1 is a side view of a part of a rifle with a barrel, a locking sleeve and a breech block.
Figure 2:
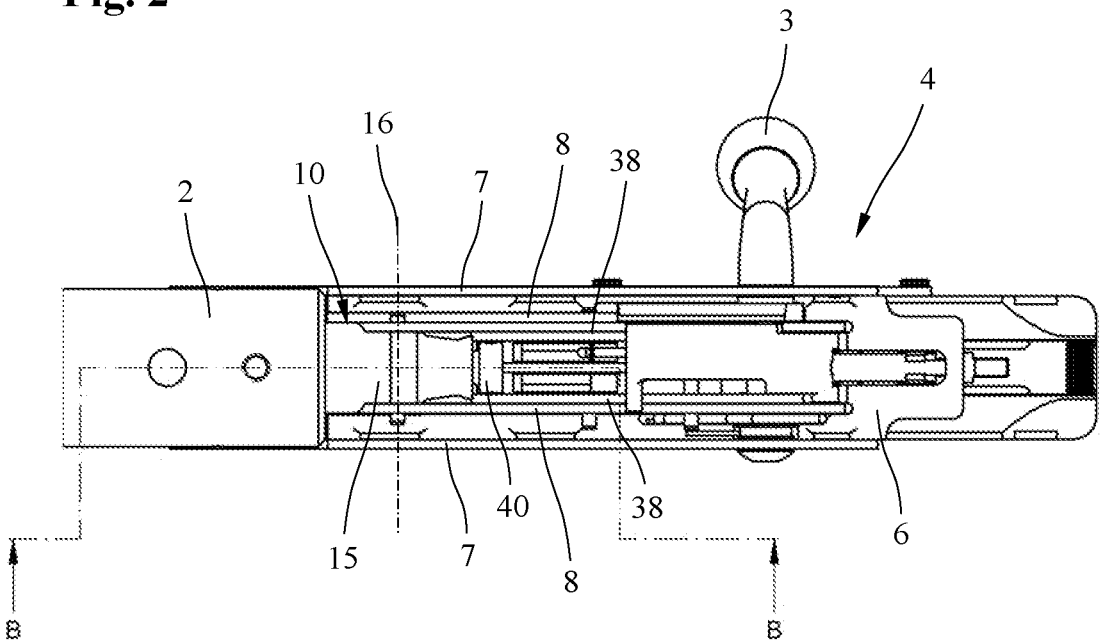
FIG. 2 is a top view of the part of the rifle with the breech block shown in FIG. 1.
Figure 3:
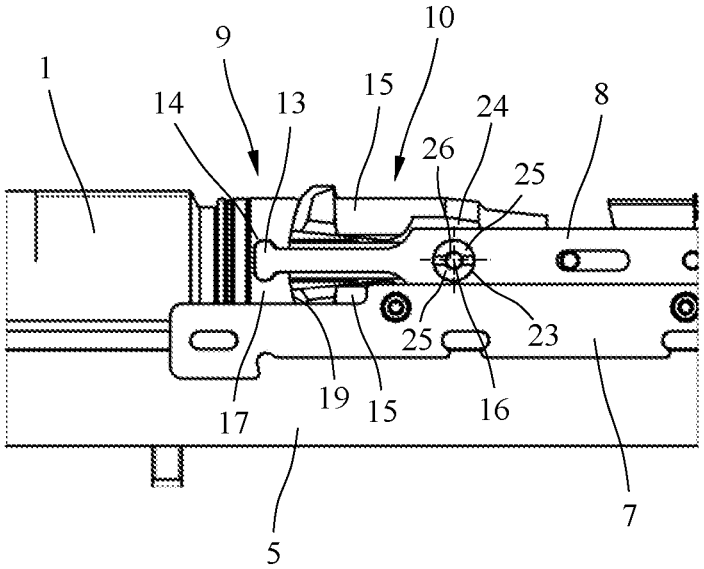
FIG. 3 is a side view of the front part of the breech block shown in FIGS. 1 and 2 with the locking sleeve hidden.

FIGS. 1 and 2 show a part of a rifle designed as a straight-pull repeating rifle with a barrel 1, a locking sleeve 2 and a breech block 4 designed here as a chamber breech and movable relative to barrel 1 by means of a bolt handle 3, between a rear opening position and a front closure position, as seen in a side view and top view. The breech block 4, which is slidably guided to move on a receiver or breech housing 5, contains a bolt carrier 6 with two parallel outer guide rails 7 and two parallel inner plate-like holding elements 8, on which a bolt head 9 shown in FIG. 3 is arranged to seal off a chamber to the rear, and a locking device 10 arranged to secure the bolt head 9 in a locking position. A trigger mechanism 11 with a trigger latch 12 visible in FIG. 1 is arranged on the receiver or breech housing 5.

As can be seen in particular from FIG. 3, the bolt head 9 is held by the front ends of the plate-like holding elements 8, which are preferably designed as sheet metal parts. For this purpose, the plate-like holding elements 8 each have a head-shaped widening 13 at the front ends thereof for shape-mated engagement in correspondingly designed diametrically opposed recesses 14 on the bolt head 9.

Figure 6A:
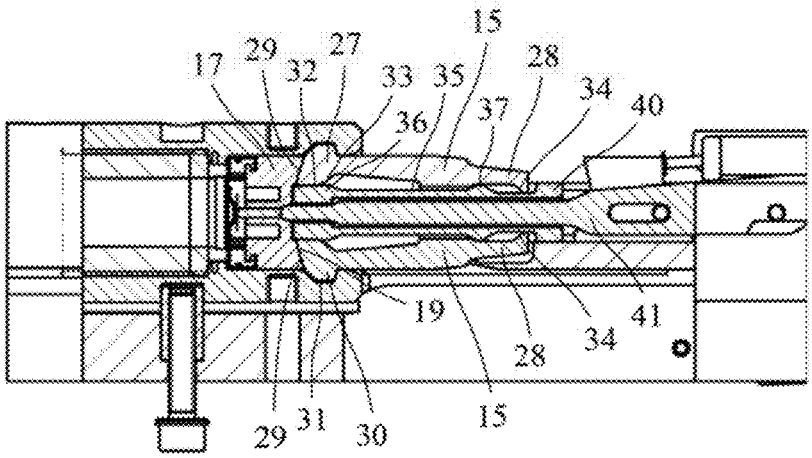
FIG. 6A is a cross section along line B-B of FIG. 2 with the locking elements in the locking position and FIG. 6B is a cross section along line B-B of FIG. 2 with the locking elements in the release position.

In the illustrative embodiment shown, the locking device 10 consists of two diametrically opposed half-shell shaped upper and lower locking elements 15 that can be pivoted between the two plate-like holding elements 8 around a common transverse axis 16 between an inwardly pivoted release position (FIG. 6B) and an outwardly pivoted locking position (FIG. 6A).

Figure 4:
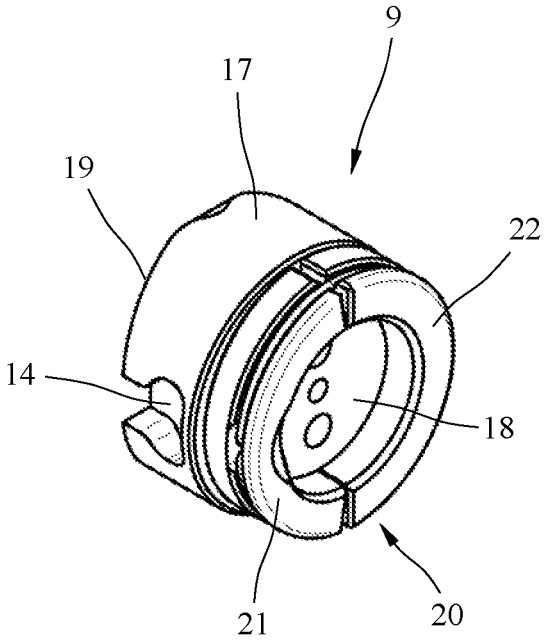
FIG. 4 is a perspective view of a bolt head of the breech block shown in FIGS. 1 and 2.
Figure 5:
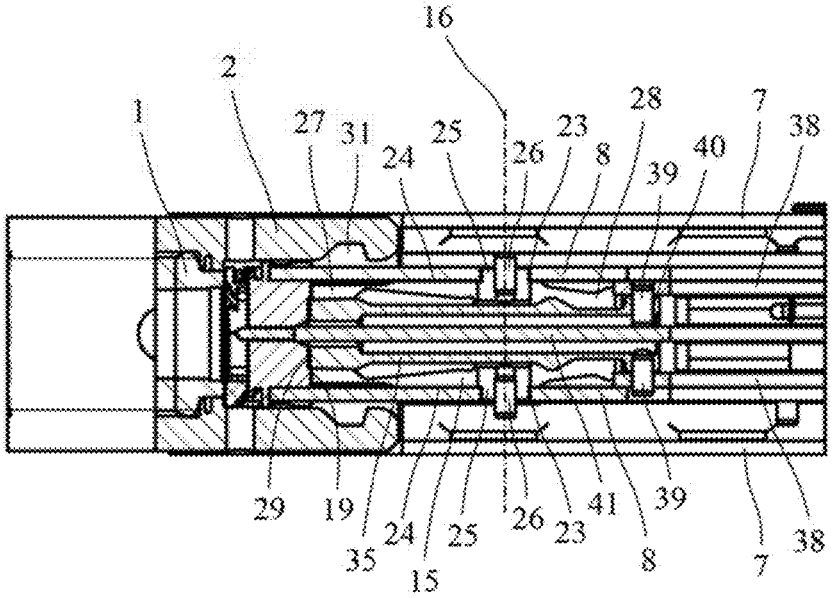
FIG. 5 is a cross section along line A-A of FIG. 1.

The bolt head 9, shown in a perspective view in FIG. 4, contains an essentially cylindrical base element 17, which, at its front side, contains a breech face 18 perpendicular to a longitudinal axis of the base element 17, and on back side, an inwardly curved guide surface 19, visible in FIGS. 3 and 5, for guiding the pivotable locking elements 15. The two opposed recesses 14 are arranged on the outside of the cylindrical base element 16 for shape-mated engagement of the front ends 13 of the two plate-like holding elements 8. The bolt head 9 also contains a bezel 20 enclosing the breech face 18 in annular fashion, which, in the embodiment shown, is formed by two half-ring-shaped bezel parts 21 and 22 detachably arranged on the front of the base element 17.

As can be seen from FIGS. 3 and 5, the two diametrically opposed upper and lower half-shell shaped locking elements 15 are mounted in aligned transverse holes 23 of the two plate-like holding elements 8 around the common transverse axis 16. For this purpose, the two locking elements 15 have two diametrically opposed flats 24 on their outside with outwardly protruding half-ring-shaped journals 25. The upper locking element 15 rests with its two diametrically opposed journals 25 against the upper inside wall of the two aligned transverse holes 23, whereas the lower locking element 15 rests with its two diametrically opposed journals 25 against the lower inside wall of the two aligned transverse holes 23. The locking elements 15 are mounted to pivot on the two plate-like holding elements 8 via the pins 26 inserted between journals 25.

Figure 6B:
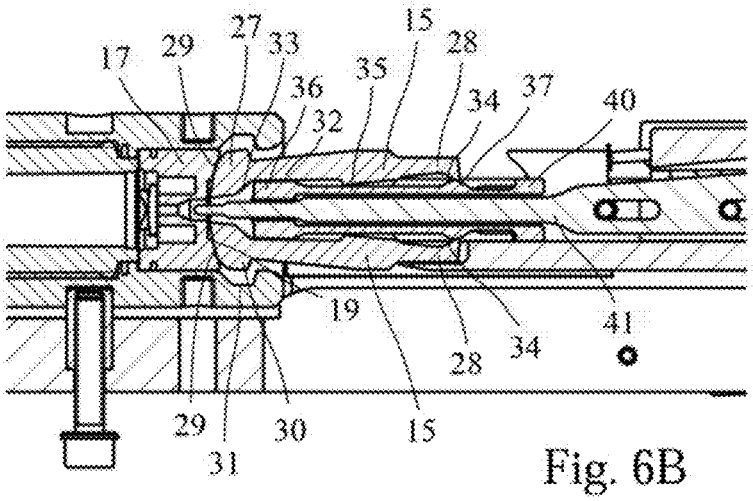
Figure 7:
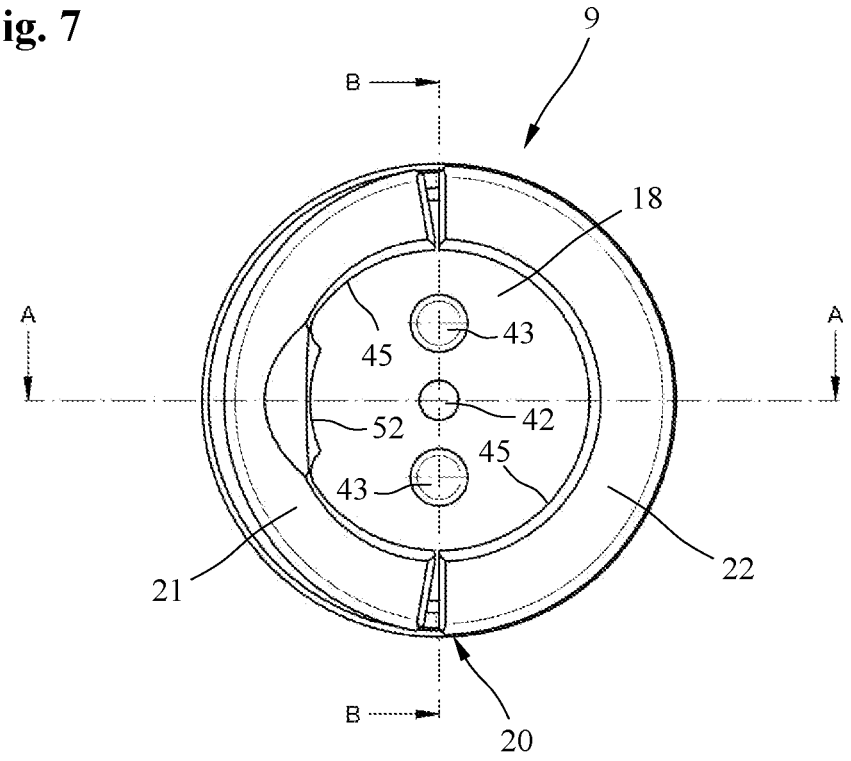
FIG. 7 is a front view of the bolt head shown in FIG. 4.
Figure 8:
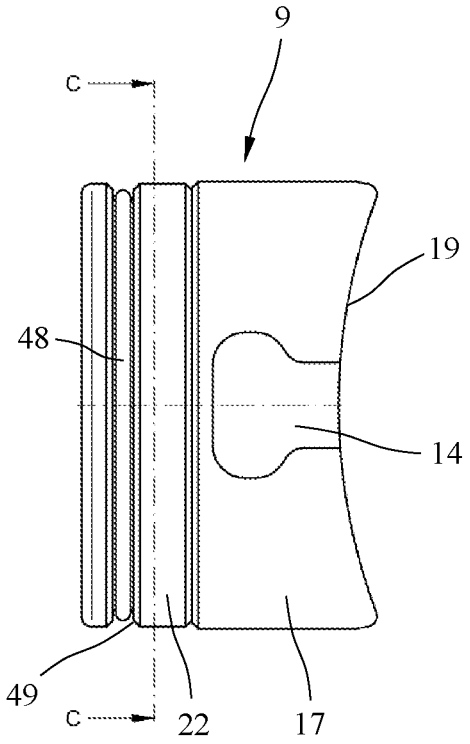
FIG. 8 is a side view of the bolt head shown in FIG. 4.
Figure 9:
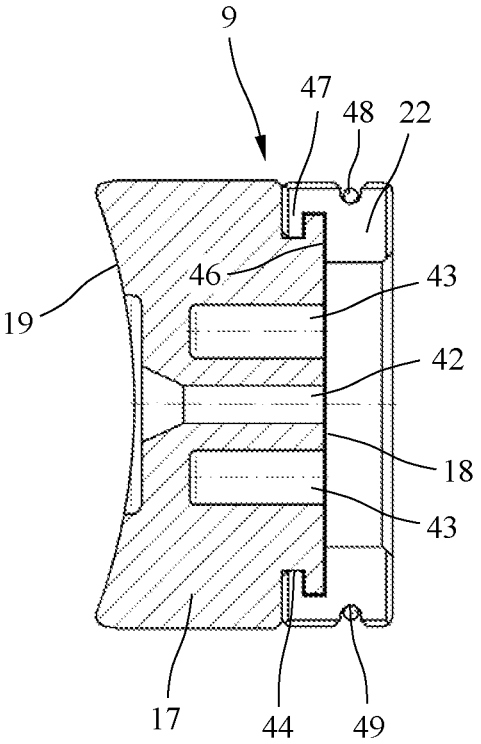
FIG. 9 is a cross section along line B-B of FIG. 7.

It can be seen in FIGS. 5 and 6A and 6B that the half-shell shaped locking elements 15 have a front part 27 protruding forward relative to journal 25 and a rear part 28 extending rearward relative to journal 25. An outwardly curved support surface 29 is provided on the front side of its front part 27, which protrudes forward relative to the journal 25, for support against the rear guide surface 19 on the back of the bolt head 9. The front support surfaces 29 of the locking elements 15 are matched to the rear guide surface 19 of the bolt head 9 so that the locking elements 15 are guided on the rear guide surface 19 of the bolt head 9 when moved between the release position and the locking position.

Half-ring- or partial-ring-shaped locking shoulders 30 are provided on the outside of the front part 27 of the locking elements 15 for engagement in an internal annular groove 31 at the rear end of the locking sleeve 2, as can be seen in FIG. 5. In the locking position of the locking elements 15, the locking shoulders 30 engage in shape-mated fashion in the annular groove 31, whereas in the release position of the locking elements 15, the locking shoulders 30 are pivoted inwardly so that the breech block 4 can be pulled rearward for opening. An inner, slightly conical support surface 32 and an oblique front control surface 33 are provided on the inside of the front part 27 of the locking elements 15 for moving the locking elements 15 into the locking position, as shown in FIG. 6A. An oblique rear control surface 34, which protrudes rearward relative to the journal 25, is arranged on the inside of the rear part 28 of the locking elements 15 for moving the locking elements 15 into the release position, as shown in FIG. 6B.

A sleeve-like control element 35 coupled to the bolt handle 3 for axial displacement is arranged between the two half-shell shaped locking elements 15 to control the movement of the locking elements 15 between the locking position and the release position. At its front end, the sleeve-like control element 35 has a front support area 36 designed as a radial widening for moving the locking elements 15 into the locking position, and a rearwardly offset ramp-like rear support area 37 for moving the locking elements 15 into the release position. The locking elements 15 can thus be forced by an axial displacement of the sleeve-like control elements 35 relative to the two locking elements 15 not only into the locking position, but also forced back into the release position without additional springs or other separate restoring elements. This reduces the cost of parts and improves reliability.

For axial displacement of the sleeve-like control element 35, the same is connected to the bolt handle 3 via two parallel plate-like push parts 38 also shown in FIG. 2 so that the control element 35 can be moved between the front locking position and a rear unlocking position by rotating the bolt handle 3. For this purpose, the two plate-like push parts 38 are connected at their front ends to a cylindrical rear end 40 of the control element 35 via pins 39, as shown in FIG. 5. If the control element 35 is pushed forward from a rear unlocking position, the locking shoulders 30 on the front part 27 of the two locking elements 15 are forced radially outward via the front support area 36 and the oblique front control surfaces 33 and held in the locking position via the conical support surface 32. When the control element 35 is pulled back into the rear unlocking position, the locking elements 15 are pivoted by contact of the rear support area 37 against the oblique rear control surfaces 34 of the locking elements 15 so that the locking shoulders 30 on the front part 27 of the two locking elements 15 are forced radially inward into the release position. Consequently, a particularly stable and functionally reliable breech block with secure locking and unlocking is achieved with relatively few inexpensively produced parts. A firing pin 41 is guided to move axially within the sleeve-like control element 35.

FIGS. 7 to 11 show a perspective view of the bolt head 9 of FIG. 4 with the essentially cylindrical base element 17 in different views. As already explained above, on its front side, the base element 17 has a breech face 18 perpendicular to the longitudinal axis of the base element 17 and, on its back side, an inwardly curved guide surface 19 for guiding the pivotable locking elements 15. A central through-opening 42 is arranged in base element 17 for guiding a front end of the firing pin 41. Two blind holes 43 open toward the front are also radially offset in base element 17 relative to through-opening 42 to accommodate pin-like, spring-loaded cartridge ejectors. The bolt head 9 also contains a bezel 20 enclosing the breech face 18 in annular fashion, which, in the embodiment shown, is formed by two bezel parts 21 and 22 detachably arranged on the front of base element 17. For this purpose, the base element 17 has a holding groove 44 on the front side thereof, which runs along the peripheral edge, and which can be seen in FIGS. 9 and 10, for shape-mated engagement of the two bezel parts 21 and 22.

Figure 10:
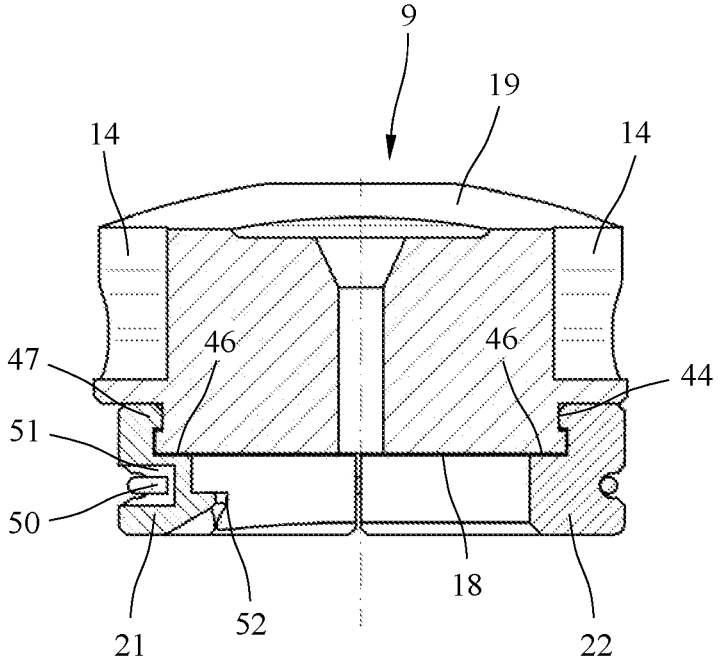
FIG. 10 is a cross section along line A-A of FIG. 7.

In the embodiment shown, two bezel parts 21 and 22 designed as half-rings are inserted into the holding groove 44 enclosing the outside base element 17. The two half-ring-shaped bezel parts 21 and 22 each have a half-shell shaped inside surface 45 for delimiting an inside diameter adjusted to the caliber. The two half-ring-shaped bezel parts 21 and 22 also contain an inner contact surface 46 on their rear side for contact with the breech face 18, and a hook-like shoulder 47 for shape-mated engagement in the holding groove 44. The two bezel parts 21 and 22 are held together via a circlip 48 and fixed in the holding groove 44. For this purpose, the bezel parts 21 and 22 contain an annular groove 49 on their outside for accommodating the circlip 48 enclosing the two bezel parts 21 and 22. For anti-rotation retention, the circlip 48 has end piece 50 at its two ends, which protrude inwardly at right angles, as shown in FIG. 10, for engagement in a radial blind hole 51 on the outside of bezel part 21. An inwardly protruding claw-shaped cartridge ejector 52 is formed integrally with the left bezel part 21 in FIG. 7 for ejecting the cartridge casing from the chamber.

Figure 11:
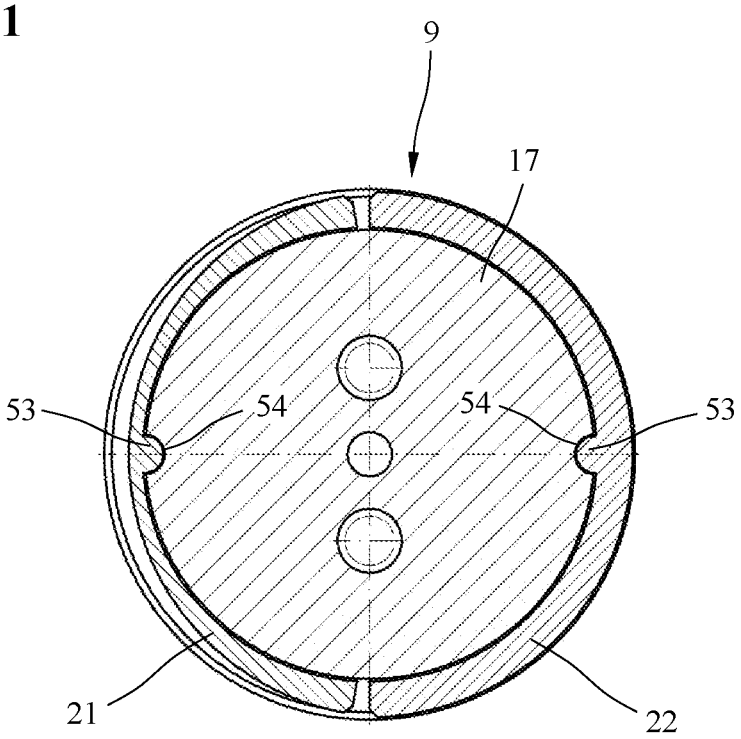
FIG. 11 is a cross section along line C-C of FIG. 8.

Positioning elements 53 shown in in FIG. 11 are arranged on the insides of the bezel parts 21 and 22 beneath the hook-like shoulders 47 shown in FIG. 10, for shape-mated engagement with corresponding mating elements 54 on the outside of the base element 17. The positioning elements 53 in the illustrative embodiment shown are designed as inwardly protruding semicircular shoulders. The mating elements 54 are designed as semicircular recesses on the outside of the base element 17. A defined position of the bezel parts 21 and 22 secured against rotation can be specified via the positioning elements 53 and the corresponding mating elements 54.

The bezel parts 21 and 22, which serve to laterally delimit the breech face 18, can thus be replaced during a change in caliber by additional bezel parts adapted to the desired caliber. By exchanging the position of the two bezel parts 21 and 22, the cartridge ejection direction can also be easily changed. For a caliber change or a change in cartridge ejection direction, complete bolt heads need not be furnished. Instead, depending on the caliber and cartridge ejection direction, correspondingly adapted bolt heads can be simply assembled and easily installed using a standardized base element. This can reduce the cost of a caliber change or adjustment of cartridge ejection direction.

LIST OF REFERENCE NUMBERS

1 Barrel
2 Locking sleeve
3 Bolt handle
4 Breech block
Receiver or breech housing
6 Bolt carrier
7 Outer guide rail
8 Inner holding element
9 Bolt head
Locking device
11 Trigger mechanism
12 Trigger latch
13 Widening
14 Recess
Locking element
16 Transverse axis
17 Base element
18 Breech face
19 Guide surface
Bezel
21 First bezel part
22 Second bezel part
23 Transverse hole
24 Flattening
Journal
26 Pin
27 Front part of locking element
28 Rear part of locking element
29 Contact surface
Locking shoulder
31 Annular groove
32 Support surface
33 Front control surface
34 Rear control surface
35 Control element
36 Front support area
37 Rear support area
38 Pusher part
39 Pin
40 Rear end of control element
41 Firing pin
42 Through-opening
43 Blind hole
44 Holding groove
45 Inside surface
46 Inside contact surface
47 Hook-like shoulder
48 Circlip
49 Annular groove
50 End piece
51 Blind hole
52 Cartridge ejector
53 Positioning element
54 Mating element

The invention claimed is:

1. A breech block with a bolt carrier, on which a bolt head and a locking device are arranged with two diametrically opposed locking elements pivotable via a control element from a release position into a locking position for holding the bolt head in a bolt head locking position, wherein the locking elements are mounted to pivot via journals around a common transverse axis and wherein the control element contains front and rear support areas which abut against the locking elements for controlled forced movement of the locking elements into both the locking position and the release position.

2. The breech block according to claim 1, wherein the locking elements are designed half-shell shaped and are pivotably mounted via two opposing journals in aligned transverse holes of two parallel holding elements.

3. The breech block according to claim 2, wherein the bolt head is held at front ends of the parallel holding elements.

4. The breech block according to claim 2, wherein the opposing journals of the locking elements are designed half-ring-shaped and the two locking elements rest with the opposing journals against an upper or a lower inside wall of the aligned transverse holes.

5. The breech block according to claim 4, wherein the two locking elements are held pivotably on the holding elements via pins inserted between the half-ring-shaped journals.

6. The breech block according to claim 1, wherein the two locking elements have an outwardly curved support surface on a front side for contact with an inwardly curved guide surface on a back of the bolt head.

7. The breech block according to claim 1, wherein the two locking elements have a front part which protrudes forward relative to the respective journal and a rear part which protrudes rearward relative to the respective journal.

8. The breech block according to claim 7, wherein outwardly protruding locking shoulders are arranged on an outside of the front part of the locking elements for engagement in an annular groove on a rear end of a locking sleeve.

9. The breech block according to claim 7, wherein an oblique front control surface is provided on an inside of the front part of the locking elements for moving the locking elements into the locking position and an oblique rear control surface is provided on an inside of the rear part of the locking elements for moving the locking elements into the release position.

10. The breech block according to claim 9, wherein the control element contains a front support area on a front end cooperating with the front control surfaces of the locking elements for moving the locking elements into the locking position and a rear support area cooperating with the rear control surfaces of the locking elements for moving the locking elements into the release position.

11. The breech block according to claim 1, wherein a firing pin is guided to move axially within the control element.

12. A rifle with a barrel, a locking sleeve and the breech block according to claim 1 wherein the breech block is movable between a rear opening position and a front closure position.

* * * * *